United States Patent [19]

Frye et al.

[11] 4,362,178

[45] Dec. 7, 1982

[54] FIGAL WASHER SYSTEM

[75] Inventors: Robert S. Frye, Decatur; Bernard M. Boehnlein, Sr., Atlanta, both of Ga.

[73] Assignee: Coca-Cola Company, Atlanta, Ga.

[21] Appl. No.: 245,060

[22] Filed: Mar. 18, 1981

[51] Int. Cl.[3] ..... B08B 9/08

[52] U.S. Cl. ..... 134/83; 134/152

[58] Field of Search ..... 220/244, 250; 134/70, 134/83, 133, 152

[56] References Cited

U.S. PATENT DOCUMENTS

| | | | |
|---|---|---|---|
| 3,099,275 | 7/1963 | Pianowski | 134/83 X |
| 3,186,577 | 6/1965 | Tennison | 220/244 |
| 4,039,350 | 8/1977 | Bucy et al. | 134/152 X |
| 4,094,329 | 6/1978 | Evans | 134/70 X |
| 4,331,230 | 5/1982 | Buckley | 134/83 X |

*Primary Examiner*—Robert L. Bleutge

*Attorney, Agent, or Firm*—Birch, Stewart, Kolasch & Birch

[57] ABSTRACT

The present invention is directed to improvements to a Figal Washer System. A Figal Washer System is a system for washing Figal five gallon syrup containers utilized in the beverage dispensing art. The improvements to the Figal Washer System of the present invention are directed to improving the production efficiency, the Figal discharge, and the time required for routine and scheduled maintenance on the Figal washing system. The modifications which are considered to contribute to the overall machine operation are directed to improvements relating to production efficiency, which include rail and carriage modifications. A rail is installed inside the washer, beginning just beyond the loading station, for providing jam protection. The figal container carriage has been modified to ensure that the Figal's remain in the carriages between the loading station and the first rinse station, two spring wheels are added. A loading guide has been added to the carriage for improving the rigidity of the carriage and for guiding the loading of the Figal's into the carriage. The two spring loaded nozzles on the carriage are fastened to a single new plate, replacing the two separate plates as previously used. To provide easier loading, the single topwheel is replaced by two independently sprung top mounted wheels. Improvements relating to the discharge include a new discharge mechanism include a front flange mounted cylinder bolted inside a sheet metal cover with a rod protruding through the cover. Improvements relating to machine maintenance include new carriage bearings, a transfer valve retracting mechanism, and a rotary actuator.

23 Claims, 19 Drawing Figures

FIGAL WASHER SYSTEM

BACKGROUND OF THE INVENTION

1. Field of the Invention

The present invention generally relates to improvements to Figal Washer Systems for washing Figal containers. More specifically, the present invention is directed to improvements relating to production efficiency, including new rail and carriage modifications, improvements relating to discharge operation of the Figal containers, and improvements relating to machine maintenance.

Figal containers as defined herein include containers similar to that illustrated in U.S. Pat. No. 3,186,577 to Tennison. The word "Figal" is an accepted abbreviation in the beverage dispensing art for a syrup container with a 5-gallon capacity.

2. Description of the Prior Art

Heretofore, Figal containers have been washed in a Figal washing system. The Figal washing system of the prior art has been inefficient due to design deficiencies and mechanical failures. These mechanical and operational problems pertain to deficient design and faulty fabrication in the areas of indexing, Figal carriers, lid holders, bearings, and operator loading. Accordingly, there is a need in the art for improvements to the Figal washing system. These improvements relate to the production efficiency of the Figal Washing Machine, improvements relating to the discharge operation in discharging the Figal containers from the washing system when the washing operation is complete, and improvements that relate to machine maintenance.

SUMMARY OF THE INVENTION

Accordingly, it is a primary object of the present invention to provide a Figal Washing System which provides improved production efficiency by the inclusion of a new rail for guiding the Figal containers through the washing system, and carriage improvements for improving the rigidity of the carriage (which carries Figal containers through the washer), for ensuring that the Figals remain in the carriers between the loading point and the first rinse station, and for providing easier loading of the Figal containers into the carriage prior to the washing operation.

It is a further object of the present invention to provide a Figal Washing System having improvements relating to the discharge operation of the Figal containers from the carriage following the completion of the washing operation.

It is still another object of the present invention to provide a Figal Washing System having improvements relating to machine maintenance for minimizing the routine or scheduled maintenance of the Figal Washing System.

The objects of the present invention are fulfilled by providing in a preferred embodiment a $1\frac{1}{4}$ inch$\times$3/16 inch$\times$29'-8" long rail installed inside of the washer around the outer periphery of the washing area. The rail begins just beyond the loading station and is positioned 12" down from the top inside of the machine and clears the Figal containers by a 1-inch margin. It is supported by horizontal supports at the edge of each removable door and with two vertical supports, one at the beginning of the rail and the other at the back end of the washer. Furthermore, the carriages, which transport the Figal containers through the washing system, have been improved by adding sidewheels, levers for holding the sidewheels, and a bar for holding the levers for improving rigidity of the carriage. Further, a single new plate has been adding in lieu of two separate plates for supporting the spring loaded nozzles located at the bottom portion of the carriage. The nozzles are responsible for introducing and extracting the washing liquid for washing the inside of the Figal container loaded thereon. The spring loaded sidewheels stabilize the Figals and ensure that the Figal containers remain in the carriers between the loading point and the first rinse station. Furthermore, to provide easier loading of the Figal container within the carriage, the single topwheel has been replaced by two independently sprung top mounted wheels.

The discharge mechanism has been improved by removing the pivoted discharge cam mechanism and replacing it with a front flange mounted cylinder bolted inside the sheet metal cover with the rod protruding through the cover. The cylinder is positioned so that the rod makes contact with the Figal container 8-inches from the lower most part of the Figal container when resting in the carrier. The rod's position is centered between the vertical angles of the carrier when in the discharge position.

The improvements relating to machine maintenance include new carriage bearings for the carriage. The bearings include a bolt portion having a shoulder position intermediate the shaft and the bolt head, and a roller portion on the shoulder portion. The shoulder provides a built in clearance for eliminating the prior art disadvantage of the roller riding on the threads of the shaft. The transfer valves are mounted to the lower rails of the washing system for connection to the Figal container carriage. The transfer valves are mounted to angles on each side of the washer. The angles form two groups, one group on each side of the washer. There are a maximum of four valves per group. Each angle has at least one. Air cylinders are attached thereto for retracting the transfer valves prior to moving the carriages from one time to another. The air cylinder extends the valves for connection to the carriage prior to the commencement of the wash cycle. The air cylinder will retract the transfer valves to allow the carriage to move into the washing position. Once in the washing position, the air cylinder extends the valves until contact is made with the carriage containing the Figal container. The washing liquid is then provided to the Figal container. The transfer valve alignment is more easily accomplished since the valves may be adjusted in groups of two, three or four, depending on location. Finally, with respect to improvements to the machine maintenance, in the prior art, known hydraulic cylinder and crank arm drive arrangements resulted in a shorter lever arm or lesser mechanical advantage when the transfer valves were subject to the greatest amount of drag. The hydraulic cylinder has been replaced by a hydraulic rotary actuator which results in a more uniform lever arm.

Further scope of applicability of the present invention will become apparent from the detailed description given herein after. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein:

FIG. 7(*b*) is a front view of the carriage bearing itself, which includes the bolt of FIG. 7(*a*) inserted within the roller which, together, constitutes the carriage bearing associated with each of the carriages of the Figal washer;

FIG. 8(*b*) is a front view of the Figal washer shown in FIG. 2, as seen from the side opposite the view shown in FIG. 2;

FIGS. 8(*c*)–8(*f*) illustrate various embodiments of the air cylinders shown in 8(*a*), connected to the angles having associated therewith the transfer valves for each of the carriages in the Figal washer;

FIG. 9(*b*) illustrates another embodiment of the use of the air cylinder for retracting the angle and the attached transfer valve which mates with the bottom portion of the carriage in transferring the washing solution to the ssociated Figal containers carried within the carriage;

FIG. 10(*b*) represents a side view of the Figal washer shown in FIG. 10(*a*) also including the rotary actuator;

DESCRIPTION OF THE PREFERRED EMBODIMENT

Figure 1:
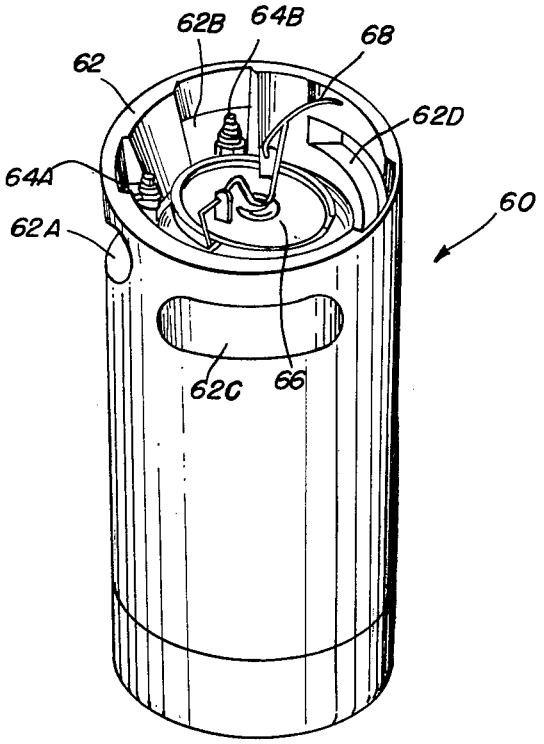
FIG. 1 is a perspective view of a typical FIGAL container to be washed in the Figal washing system.

Referring in detail to FIG. 1 there is illustrated a typical FIGAL container to be washed within the FIGAL washing system of the present invention. The container as generally indicated by the numeral 60, is fabricated of stainless steel or other suitable materials and includes a top rubber protective skirt 62. Skirt 62 has four openings about the periphery thereof, including openings 62A, 62B to give access to valves 64A, 64B disposed on the top of the container and openings 62C and 62D forming handles, so that the container may be manually lifted. The top of the container also includes a closure member 66 which opens inwardly into the container when handle 68 is raised as shown in FIG. 1.

Two valves 64A and 64B are provided for the pressurization of the syrup in container 60 with $CO_2$ or nitrogen and the dispensing of the syrup from the container 60 when it is connected to a post-mix beverage dispenser, respectively. It is important that both of these valves 64A, 64B be tightened prior to filling the container 60 with syrup and pressurizing the same. The two valves 64A and 64B are also used in conjunction with the FIGAL washer of the present invention for introducing the washing liquid into the FIGAL container and for extracting the washing liquid therefrom, in the process of washing and rinsing the FIGAL container in the FIGAL washer in the present invention.

Figure 2:
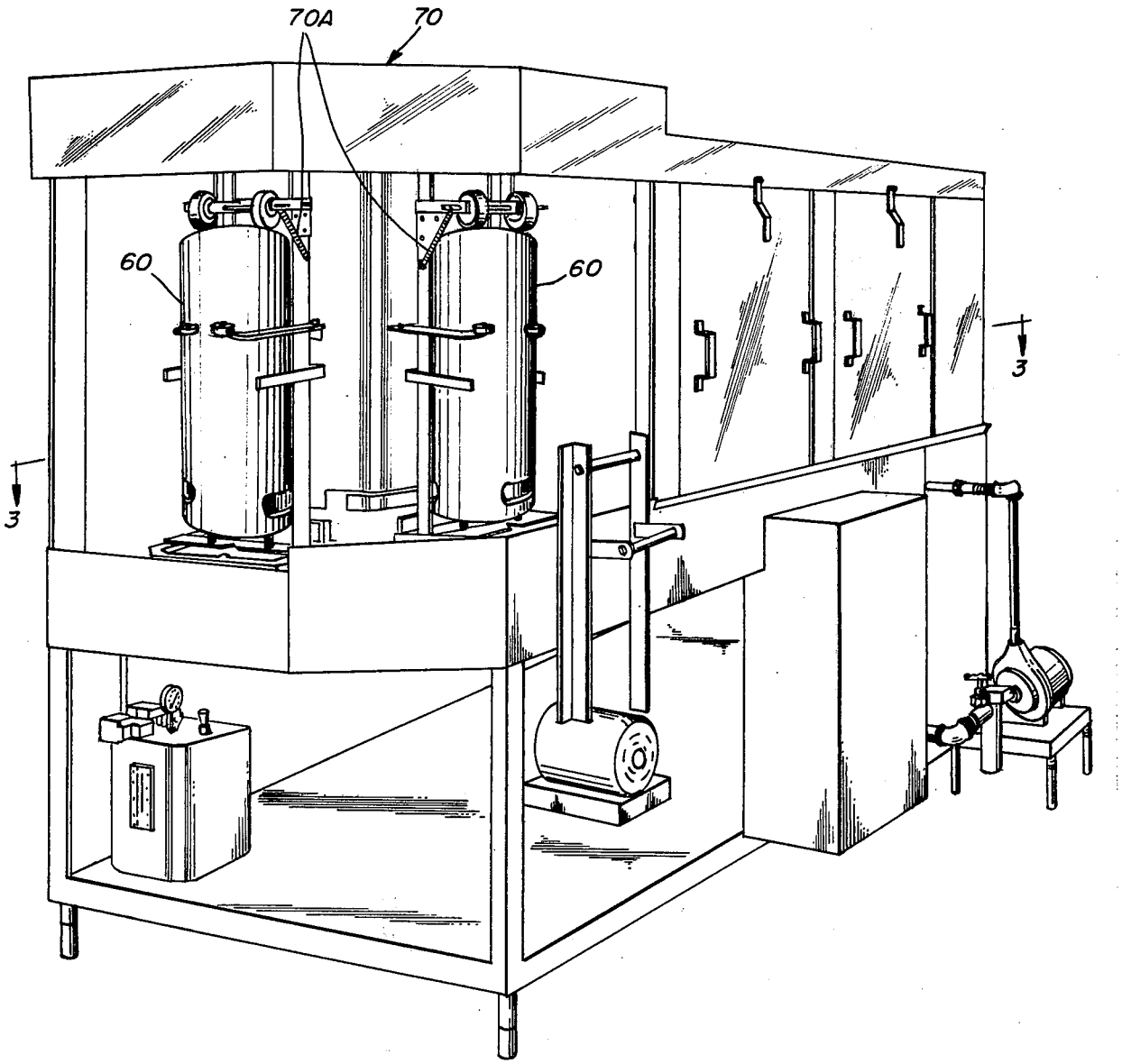
FIG. 2 is a perspective view of a typical FIGAL washing system.

Referring to FIG. 2, the FIGAL Washer 70, of the present invention, is shown. The FIGAL Containers 60 are shown inserted upside down within their respective carriages 70A, which carry the FIGAL containers 60 through the FIGAL washer 70. The carriages 70A move around the outer periphery of the washer 70. The Figal containers 60, and their carriages 70A move through washing and rinsing zones. When complete the Figal containers are ejected, individually, from the washer.

Figure 3:
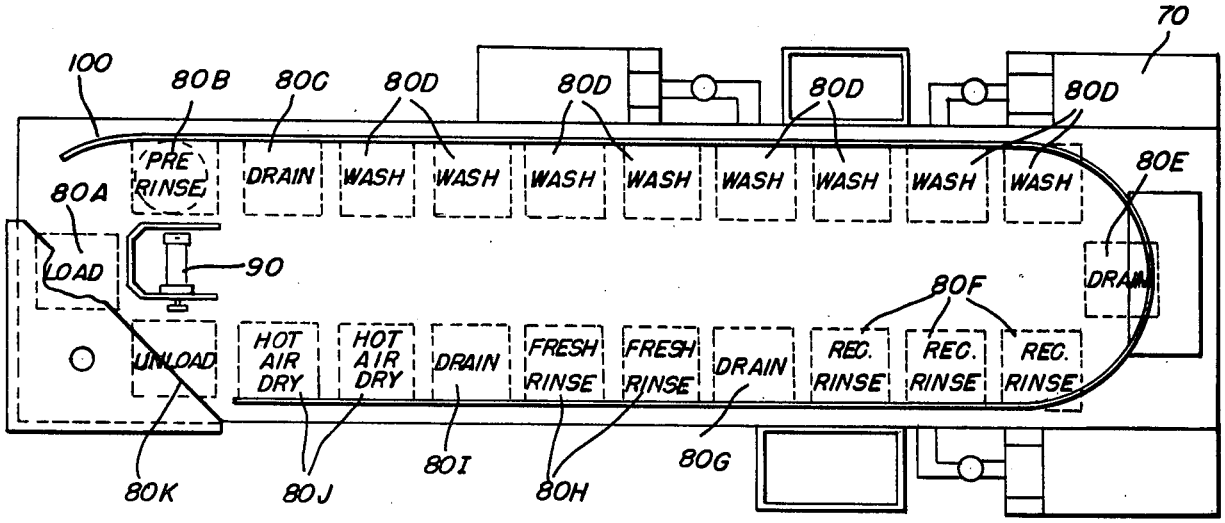
FIG. 3 is a top view of FIG. 2, in section, taken along section lines 3—3 of FIG. 2.

Referring to FIG. 3, a top view of the FIGAL washer 70, taken along section lines 3—3 of FIG. 2 is shown. In FIG. 3, there is illustrated various zones which represent the location within the washer for washing and rinsing the FIGAL containers 60 as they move through the FIGAL washer 70. The FIGAL container 60 is initially loaded into the FIGAL washer 70 at the loading zone 80(*a*). The FIGAL container which was loaded at the loading zone 80(*a*) travels clockwise through the FIGAL washer 70, travelling initially to a pre-rinse zone 80(*b*). Once the pre-rinse cycle is complete, the FIGAL container 60 will travel to a drain zone 80(*c*) for draining the pre-rinse water from the FIGAL container 60. Then, the FIGAL container 60 will pass through various wash zones 80(*d*), which wash the FIGAL container by passing a washing liquid through the valves 64A and 64B of the FIGAL container 60. Once the FIGAL container 60 has completed the wash cycle by passing through of the wash zones 80D, it enters a drain zone 80E for draining the washing liquid from the FIGAL container. At this point, the FIGAL container 60 will then enter a recirculate rinse zone 80F for rinsing the FIGAL container. The container will then enter another drain zone 80G for draining the rinse water from the FIGAL container. Then, the FIGAL container 60 will enter another rinse zone called the Fresh Rinse Zone 80H for again rinsing the FIGAL container. The container will pass through still another drain zone 80I for draining the rinse water therefrom. It will then pass through hot air dry zones 80J for drying the inside of the FIGAL container. Following the completion of the hot air dry cycle in the hot air dry zone 80J, the FIGAL container will enter an unload zone 80K. In this zone, a discharge cylinder 90 will eject the FIGAL container from the FIGAL washer 70. The details of this discharge cylinder 90 will be discussed at a later portion of this application.

Also, shown in FIG. 3, the FIGAL washer 70 further includes a rail 100 for guiding the FIGAL container through a FIGAL washer. The rail 100 begins between the load zone 80A and the pre-rinse zone 80B. It continues around the outer periphery of the FIGAL washer, encompassing each of the zones of the FIGAL washer and finally terminating at a point between the unload zone 80K and the last hot air dry zone 80J. The rail 100 is used to provide jam protection for the FIGAL washer, in preventing the FIGAL container 60 from jamming the operation of the FIGAL washer as the FIGAL container 60 travels through each of the zones of the FIGAL washer 70.

Figure 4:
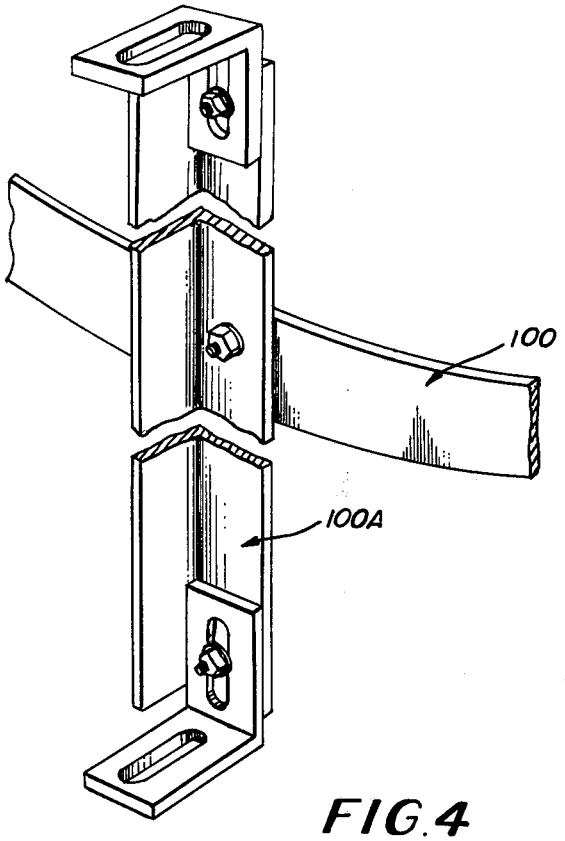
FIG. 4 is a perspective view of one of the vertical supports of the Figal washer shown in FIGS. 2 and 3, having the stainless steel rail firmly secured thereto.
Figure 5:
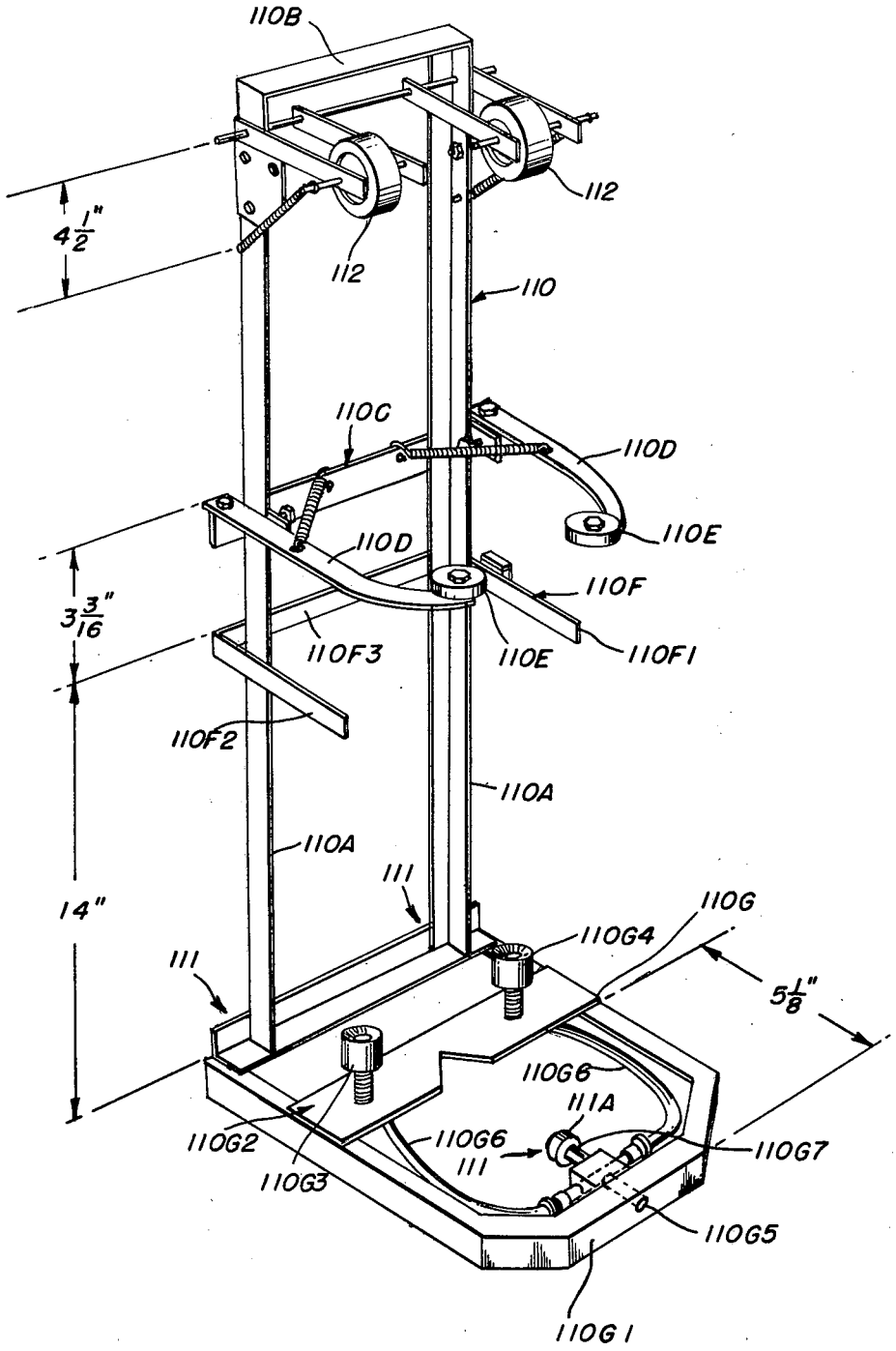
FIG. 5 is a perspective view of one of the improved carriages used in the Figal washer of FIG. 2.

Referring to FIG. 4, an enlarged perspective view of the rail 100 is shown, supported by the vertical support of 100A. These vertical supports 100A are present at various locations around the outer periphery of the wash and rinse zones of the FIGAL washer 70. The rail is preferably made of stainless steel, having the following dimensions: $1\frac{1}{4}''\times 3/16''\times 29'\text{-}8''$. The rail 100 is positioned 12" down from the top inside of the machine and clears the FIGAL containers by a 1-inch margin. It is supported by horizontal supports at the edge of each removable door and with two vertical supports, one at the beginning of the rail, and the other at the back end of the washer. This rail, in combination with the loading guides to be illustrated in FIG. 5, is estimated to provide a 14% improvement in production efficiency of the FIGAL washer 70. When these modifications are combined with all of the carriage modifications, to be described later, an additional 5% improvement may be expected for an efficiency improvement from 76 to 95%.

Referring to FIG. 5, an improved carriage 110 is shown, which is the carriage for transporting the FIGAL container 60 throughout the FIGAL washer 70 shown in FIG. 2. The carriage 110 includes two stainless steel angles 110A, which have the following dimensions: $1\frac{1}{4}''\times 1\frac{1}{4}''\times 3/16''$. These angles 110A are joined at their top portion by a bar 110B. Approximately 17-3/16 inches from the bottom of the carriage, there is positioned a second bar 110C for holding two lever arms 110D in an outwardly extending position. At the outer extremity of each of these two lever arms 110D, there are located sidewheels 110E. Approximately 14-inches up from the bottom of the carriage, there is included, in combination with the stainless steel angles 110, a loading guide 110F. This loading guide includes a first outwardly extending portion 110F1, a second outwardly extending portion 110F2, and a third horizontally extending portion 110F3 for connecting the first and second outwardly extending portions 110F1, and 110F2 to the two vertically oriented stainless steel angles 110A.

The base 110G of the carriage 110 includes a base frame 110G1, which connects with the bottom portion of the stainless steel angle 110. A single plate 110G2 straddles and is connected across the upper portion of the base 110G1 of the carriage 110. This single plate 110G2 has connected thereto two valves 110G3 and 110G4. The valves 64A and 64B of the FIGAL container 60 connects to the valves 110G3 and 110G4 of the carriage base 110G1. In this way, the FIGAL container 60 is placed upside down within the carriage 110, as it travels and passes through the FIGAL washer 70. A carriage bearing 111 is shown associated with the carriage base 110G1. The details of the construction of the carriage bearing will be discussed with reference to FIGS. 7A and 7B of the drawings of the present application. The carriage bearing 111 includes a roller portion 111A which rolls along a horizontal shaft within the FIGAL washer 70. Two additional carriage bearings 111 (not shown) are placed at the rear of the carriage base 110G1 for transporting the carriage through the FIGAL washer 70. The carriage base 110G1 further includes a small porthole 110G5 located and passing through the front portion of the carriage base 110G1. The porthole 110G5 provides a communication passageway directed to each of the hoses 110G6. The hoses 110G6 are connected at one end, to the porthole 110G5, and is connected at each of their other ends to the valves 110G3 and 110G4, respectively. In this way, water is introduced into the porthole 110G5, passes through each of the hoses 110G6, and enters the valves 110G3 and 110G4, respectively, for washing the inside of the FIGAL containers 60.

At the top portion of each of the stainless steel angles 110A, there is located, associated with each of the angles 110A, two independently sprung top mounted wheels 112, respectively. There are two top mounted wheels in order to provide an easier loading of the FIGAL container 60 into the carriage 110 and to further ensure that the Figal container 60 does not fall out of its carriage 110.

The stainless steel angles 110A in combination with the lever arms 110D, for holding the sidewheels 110E, and the loading guides 110F result in an improved rigidity of the carriage 110. In addition, a single new plate, 110G2 is used for holding the valves 110G3 and 110G4, in lieu of the prior art wherein two separate plates were used, which were often out of alignment. In addition, in order to ensure that the FIGAL containers 60 remain in the carriers between the loading point and the first rinse station, (the rail 100 begins just past the loading point), spring loaded sidewheels 110E were added. Finally, the presence of two independently sprung top mounted wheels 112 provide easier loading of the FIGAL containers 60 within the carriage 110.

Figure 6:
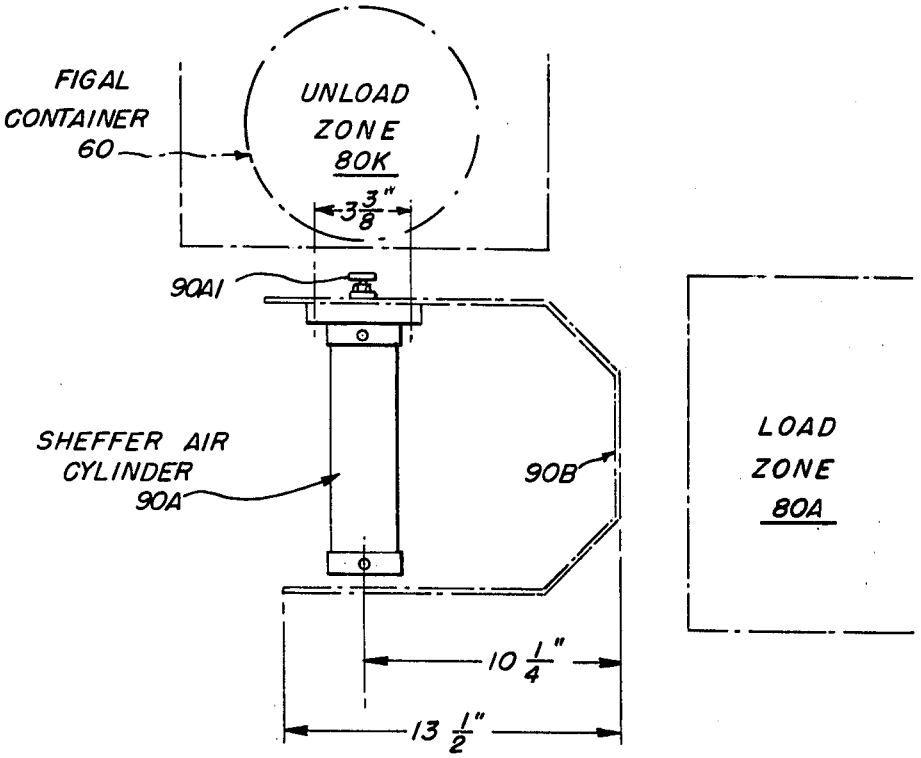
FIG. 6 is an enlarged view of the discharge cylinder shown in FIG. 3.

Referring to FIG. 6, an enlarged view of the discharge mechanism 90 shown in FIG. 3 is illustrated. In the prior art device, a pivoted discharge cam mechanism was utilized. In the present case, however, this pivoted discharge cam has been replaced with a front flange mounted cylinder 90A bolted inside a sheet metal cover 90B with the rod 90A1 of the discharge cylinder 90A protruding through the cover 90B. The rod 90A1 is centered between the vertical stainless steel angles 110A of the carrier 110. The cylinder 90A is positioned so that the rod 90A1 makes contact with the FIGAL container 60, 18-inches from the lower most part of the FIGAL container when it is resting in the carriage 110. The discharge cylinder 90A is an air cylinder and is of the following type: Sheffer 2AF 6 with a 2-inch diameter bore and a 6-inch stroke. In operation, when the FIGAL container 60 enters the unloading zone 80K, the rod 90A1 of the discharge cylinder 90A extends outwardly from the position shown in FIG. 6 and forces the FIGAL container out of the unloading zone, and out of the FIGAL washer 70.

Figure 7A:
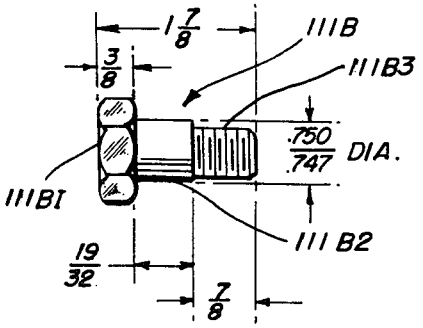
FIG. 7(*a*) is a side view of the bolt having the shoulder associated therewith, which is used with the carriage bearing associated with the carriage of the Figal washer.
Figure 7B:
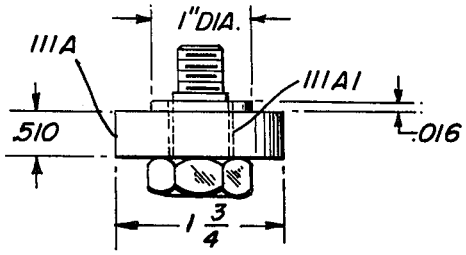

Referring to FIG. 7A and 7B, the carriage bearing 111 as shown in FIG. 5 of the drawings of the present application will be further illustrated in detail. Referring to FIG. 7A, the bolt portion 111B of the carriage bearing 111 is shown. The bolt portion 111B includes the bolthead 111B1, a shoulder portion 111B2 and a shaft portion 111B3, having a diameter which is less than the diameter of the shoulder portion 111B2. The shaft portion 111B3 is threaded, having the following thread configurations: thread ½"-13 UNC. The dimensions of the bolt are shown in FIG. 7A. The diameter of the shoulder portion 111B2 is approximately 0.750 divided by 0.747 diameter. The width of the head portion 111B1 of the bolt 111B is approximately ⅜ of an inch. The length of the bolt itself is 1⅞-inches. The length of the shoulder is 19/32-inch. The length of the shaft 111B3 is approximately ⅞-inch. The diameter of the head portion 111B1 of the bolt 111B is approximately ⅞-inch. From tip to tip, the head portion 111B1 measures 1.017 inch. The bolt portion 111B of the carriage bearing 111 is fabricated from Ampco Bronzes, 15 or 45 for the shaft.

Referring to FIG. 7B, the roller portion 111A of the carriage bearing 111 is illustrated. In FIG. 7B, a front view of the roller portion is shown. The roller 111A is positioned such that the shoulder 111B2 of the bolt 111B is placed within a center bore 111A1 of the roller 111A. The length of the shoulder 111B2 is slightly greater than the width of the roller 111A. Note that the width of the roller shown in FIG. 7B is measured to be 0.526" (0.510"+0.016"). The length of the shoulder 111B2 shown in FIG. 7A is measured to be 19/30 of an inch. Therefore, the length of the shoulder (19/32") is slightly greater than the width of the roller (0.526"). Due to the fact that the length of the shoulder 111B2 of the bolt 111B is slightly greater than the width of the roller 111A, the carriage bearing 111 provides a built in clearance. In the prior art, there was no such shoulder 111B2 used in conjunction with the bolt 111B. Consequently, when the bolt of the prior art was inserted into the roller 111A, the threads of the shaft 111B3 would ride directly on the internal peripheral surface of the bore 111A1. This would decrease the lifetime of the prior art carriage bearing. By providing a shoulder 111B2 as shown in FIG. 7A, the threads of the shaft 111B3 no longer ride directly on the internal peripheral surface of the bore 111A1. Consequently, the lifetime of the carriage bearing of the present invention is drastically increased. The built in clearance (wherein the length of the shoulder is slightly greater than the width of the rollers) enables the roller 111A to ride freely on the shoulder 111B2 of the bolt 111B.

Referring again to FIG. 5 of the drawings of the present application, note the position of the carriage bearing 111. The shaft 111B3 of the carriage bearing is screwed directly into the portion of the base designated by numeral 110G7. The roller 111A is riding on the shoulder 111B2 of the bolt 111B, and due to the built in clearance mentioned above, the roller 111A rides freely on the bolt 111B, since there is enough space along the length of the shoulder 111B2 for the roller 111A to ride free without interference.

Figure 8A:
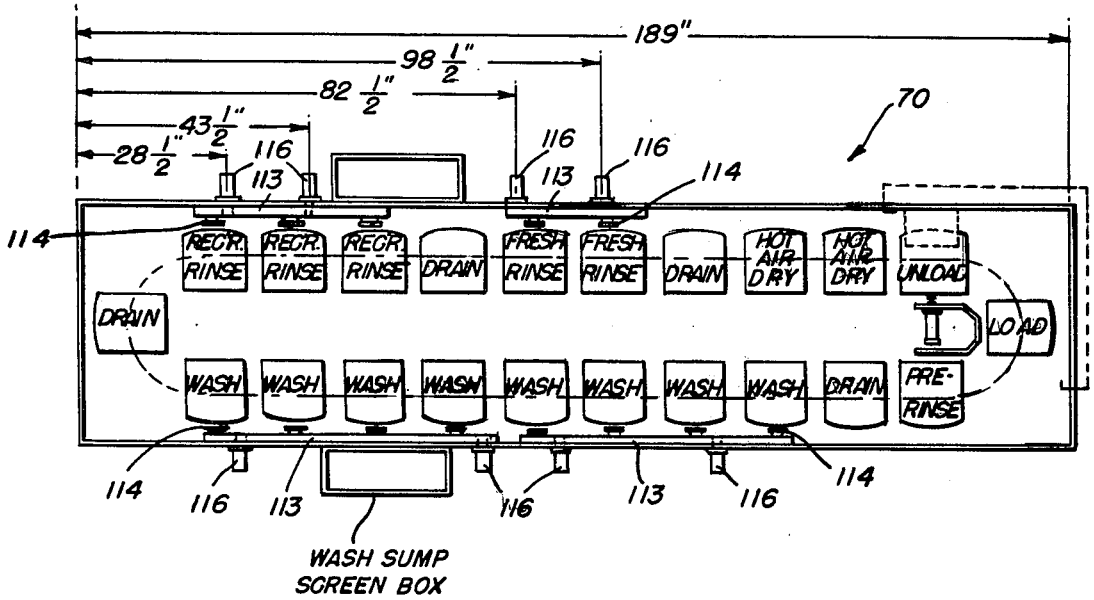
FIG. 8(*a*) is another top view of the Figal washer shown in FIG. 2, similar to the top view shown in FIG. 3, further including the air cylinders for retracting the angles which have associated therewith the transfer valves for each of the carriages in the Figal washer.
Figure 9A:
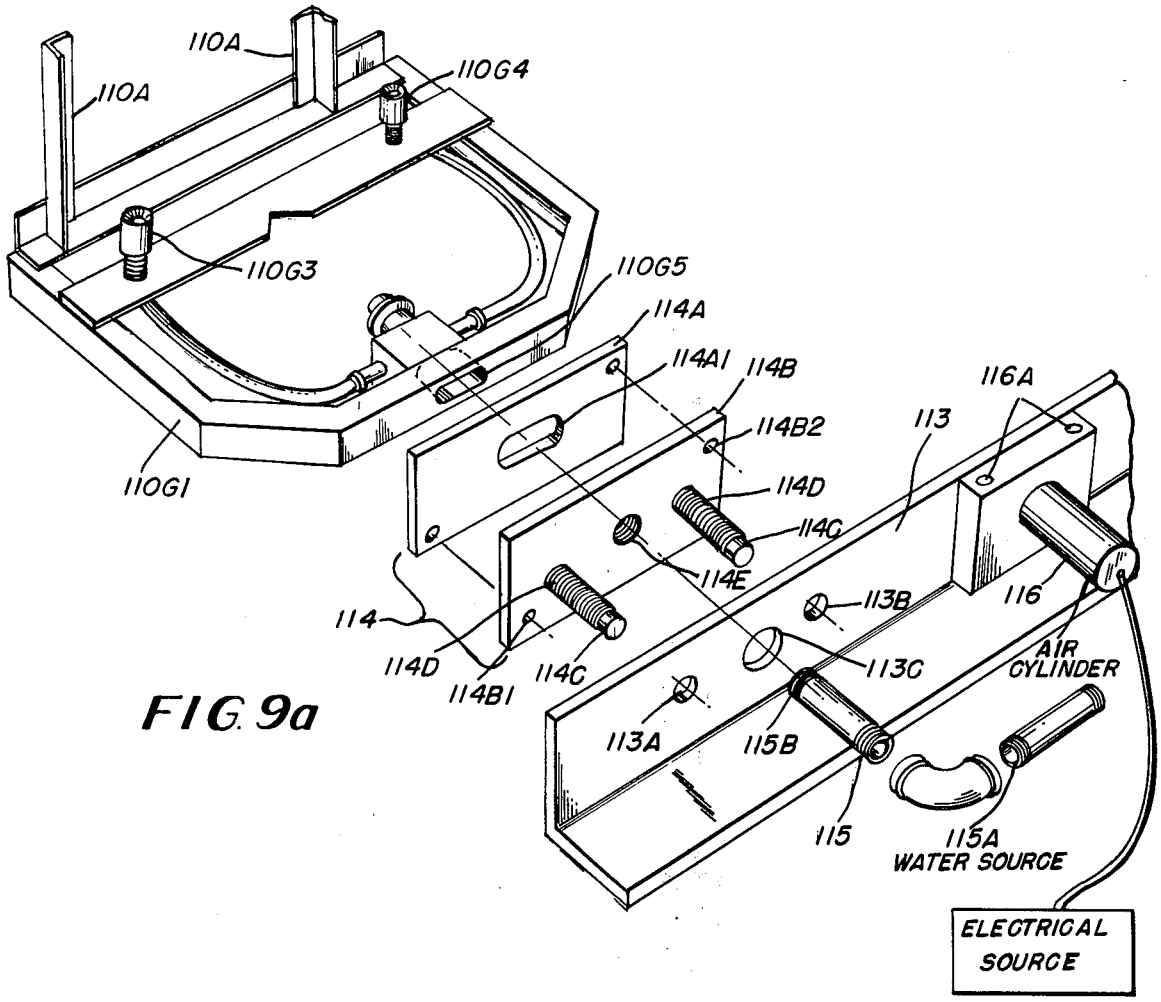
FIG. 9(*a*) illustrates a perspective view of the air cylinder for retracting the angle having attached thereto one of the transfer valves which mate with the bottom portion of the carriage for transferring a washing liquid thereinto.
Figure 9B:
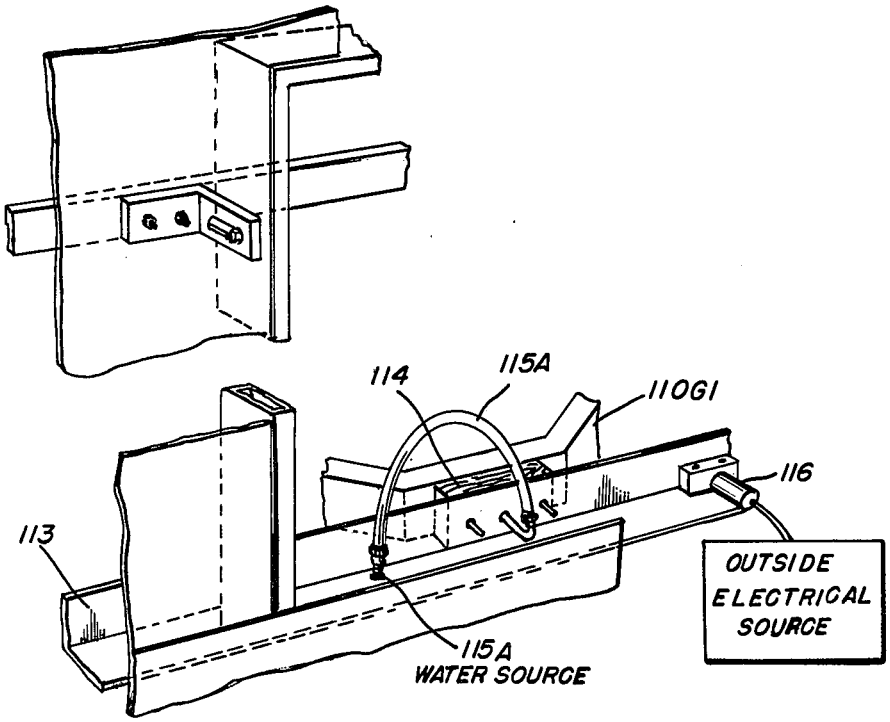

Referring to 8A–8F and FIGS. 9A–9B, the following represents a discussion of the transfer valves associated with each of the wash and rinse zones shown in FIGS. 3 and 8A, and their associated air cylinders.

Referring first to FIG. 9A, an angle 113 is shown. This angle 113 can also be seen in FIG. 8A, in that it is positioned on both sides of the FIGAL washer 70 at various positions along the length thereof. Referring again to FIG. 9A, this angle 113 has two holes 113A and 113B drilled therethrough. Centrally located between these two holes 113A and 133B, a third hole of larger diameter 113C is shown.

A transfer valve 114 is shown in FIG. 9A which includes a block 114A, a face plate 114B attached thereto. The block 114A is attached to the face plate 114B via screw or bolt holes 114B1 and 114B2. Two rods 114C extend from the face plate 114B, and are interposed between the face plate 114B and the angle 113. Helically wound around each of the rods 114C are springs 114D. When the block 114A is attached to the face plate 114B, the rods 114C are inserted into and through the holes 113A and 113B of the angle 113. The outer diameter of the springs 114D is greater than the inner diameter of each of the holes 113A and 113B. Located at the center of the face plate 114B, there is a threaded hole or bore 114E disposed therethrough. The inner surface of the bore 114E is threaded along the entire length thereof.

A pipe 115 is connected at one end to a water source 115A. The other end of the pipe 115 is designated by the numeral 115B. The other end 115B of pipe 115 is inserted through hole 113C of angle 113 and threadedly engaged with the bore 114E of the face plate 114B. At this point, the transfer valve 114 is connected to the angle 113 by virtue of the connection of the pipe 115 to the center bore 114E of the face plate 114B.

An air cylinder 116 is also connected to the angle 113, on the same side as is disposed the pipe 115. The air cylinder 116 is connected to the angle 113 by virtue of bolts or other means 116A. The air cylinder 116 possesses the ability, by virtue of a solenoid therein, to create a push-pull action for pushing the angle 113, and its associated transfer valve 114, forwardly, and for pulling the angle 113, and its associated transfer valve 114, rearwardly.

Referring again to FIG. 9A, note the position of the carriage base. In particular, note the position of the porthole 110G5, which passes through the forward portion of the carriage base 110G1, and the manner by which it aligns with a center hole 114A1 in the block 114A, with the bore 114E passing through the center of the plate 114B, with the hole 113C disposed through the angle 113, and with the pipe 115 which contains the water from the water source 115A. When the carriage base 110G1 is in the position shown in FIG. 9A, the FIGAL container 60 carried therein is positioned at one of the wash or rinse zones shown in FIG. 8A.

Referring to FIG. 8A, on each side of the FIGAL washer 70, there are two angles 113. Associated with each angle, there are two air cylinders 116 attached thereto for moving the angles 113 forwardly and backwardly in a push-pull fashion. On the other side of the FIGAL washer 70, there are also two angles 113, each angle having two air cylinders 116 attached thereto for moving the angles 113 forwardly and backwardly in a push-pull fashion. When the air cylinders 116 are energized by an outside electrical source, the air cylinders will move the angles 113 backwardly in order to disengage the block 114A from the carriage base 110G1. Each of the blocks 114A will therefore be disengaged, allowing each of the FIGAL containers 60, present in the carriage 110, to move to the next location or the next zone. Once the carriages and their associated FIGAL containers are moved to the next adjacent zone, the air cylinder 116 will then move their associated angles forwardly causing the transfer valves 114, and specifically, the block 114A associated with the transfer valves, to engage with the forward portion of the carriage base 110G1. When the transfer valves 114 engage with the forward portion of the carriage base 110G1, each of the following holes will be aligned together:

hole 110G5 in the carriage base 110G1,
hole 114A1 in the block 114A,
hole 114E in the face plate 114B,
hole 113C in the angle 113.

At this point, the water source 115A will supply water, via pipe 115, to the carriage base 110G1, the water being transported through hoses 110G6 in the carriage base, and through the valves 110G3 and 110G4 for washing the inside of the FIGAL container 60.

Figure 8B:
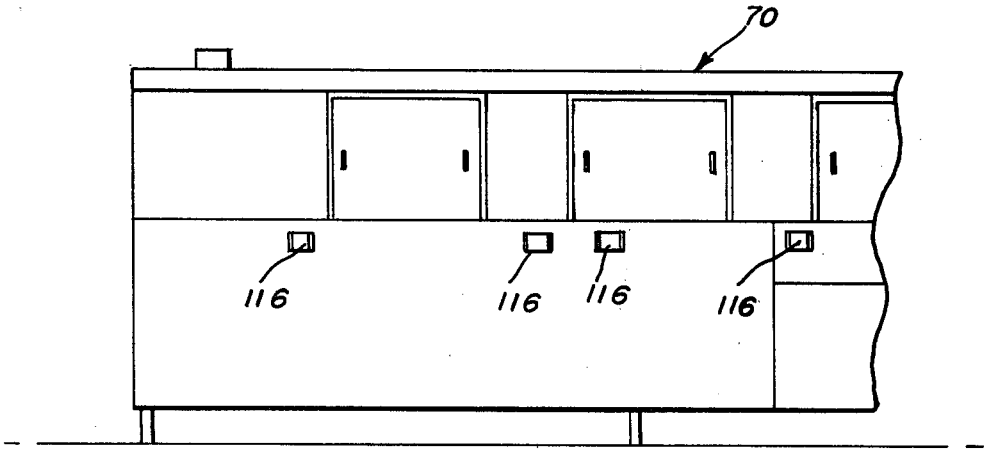
Figure 8C:
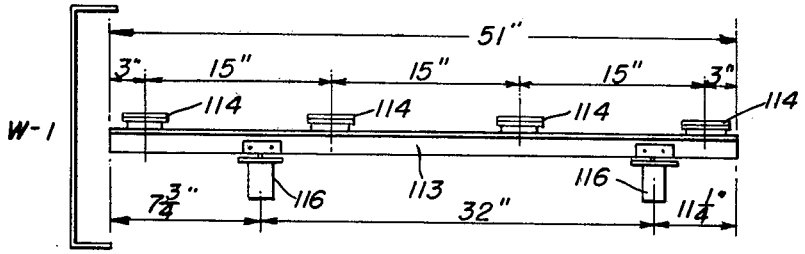
Figure 8B:
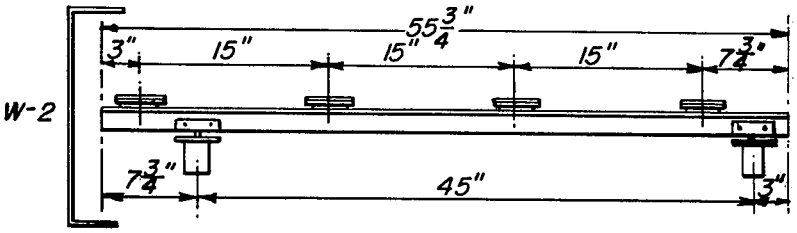
Figure 8E:
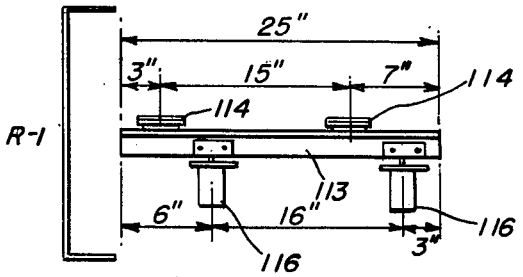
Figure 8F:
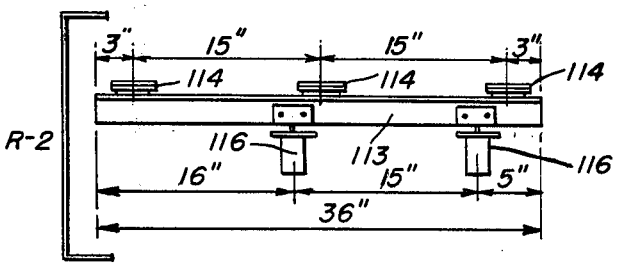

FIG. 8B shows a front view of the FIGAL washer 70, as pictured in FIG. 8A. Note the position of the air cylinder 116 relative to the front view of the FIGAL washer 70.

In FIGS. 8C through 8F, four embodiments are shown, showing the relative positions of the air cylinders 116, mounted to the angle 113, with the transfer valves also mounted to the opposite end of the angle 113. The air cylinders 116 may be located at various points along the angle 113 relative to their transfer valves 114, as shown in FIGS. 8C–8F.

Referring to FIG. 9B, note the alternative method of carrying the water from the water source 115A. The water will travel through a hose 115A, as opposed to the piping 115, as shown in FIG. 9A.

In the prior art, the air cylinder 116 was not used to retract the angle 113 prior to moving the carriages to the next adjacent zone. Rather, the transfer valves 114 were spring loaded in an extended position. The carriages would move to the adjacent zone. Since the transfer valves 114 were in an extended position, when the carriages moved to the adjacent zone, a drag was created on the carriages causing an increased chain stretch and, consequently, hinge and spring distortion occurred which reduced the required frequency of realignment. However, these disadvantages have been overcome by virtue of the present invention, utilizing the air cylinder, attached to the angles 113, for moving the angles 113 and their transfer valves 114 in a push-pull fashion, as discussed above.

Figure 10A:
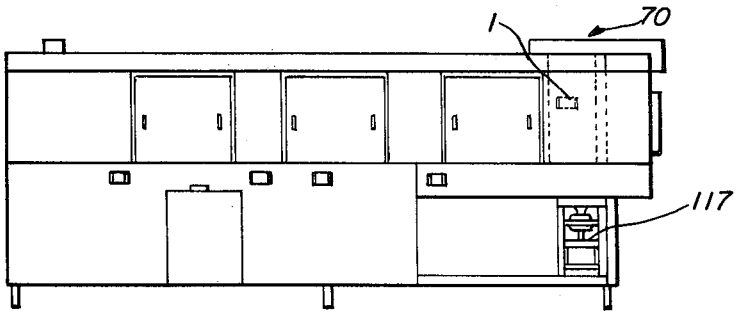
FIG. 10(*a*) represents a front view of the Figal washer shown in FIG. 2, as presented in FIG. 8(*b*), including the rotary actuator for rotating the sprocket wheel and the carriage throughout the Figal washer.
Figure 10B:
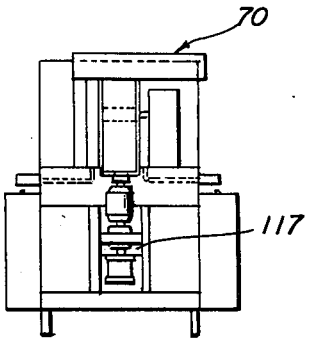

Referring to FIG. 10A, a front view of the FIGAL washer 70 is illustrated. FIG. 10B illustrates a side view of the FIGAL washer 70, shown in FIG. 10A. In these figures, the location of the rotary actuator 117 is shown. The rotary actuator drives a sprocket (not shown), which in turns drives a drive chain. The drive chain is connected to each of the carriages 110 and moves each of the carriages from one zone to another. Consequently, the rotary actuator 117 is the main drive unit for driving the carriages from one zone to another, throughout the FIGAL washer 70, for washing the individual FIGAL containers 60 therein.

The original washer contained a hydraulic cylinder and crank arm drive arrangement. This resulted in the shortest lever arm or least mechanical advantage when the transfer valve had the greatest amount of drag, that is, when the transfer valves made contact with the carriage base, at the beginning and at the end of the carriage travel, from one zone to another. The hydraulic cylinder used in the prior art washer has been replaced with a hydraulic rotary actuator 117 which results in a uniform lever arm. In addition, the retraction of the transfer valves by using the air cylinder 116, as discussed above, eliminates the initial and end drag on the drive unit.

Figure 11:
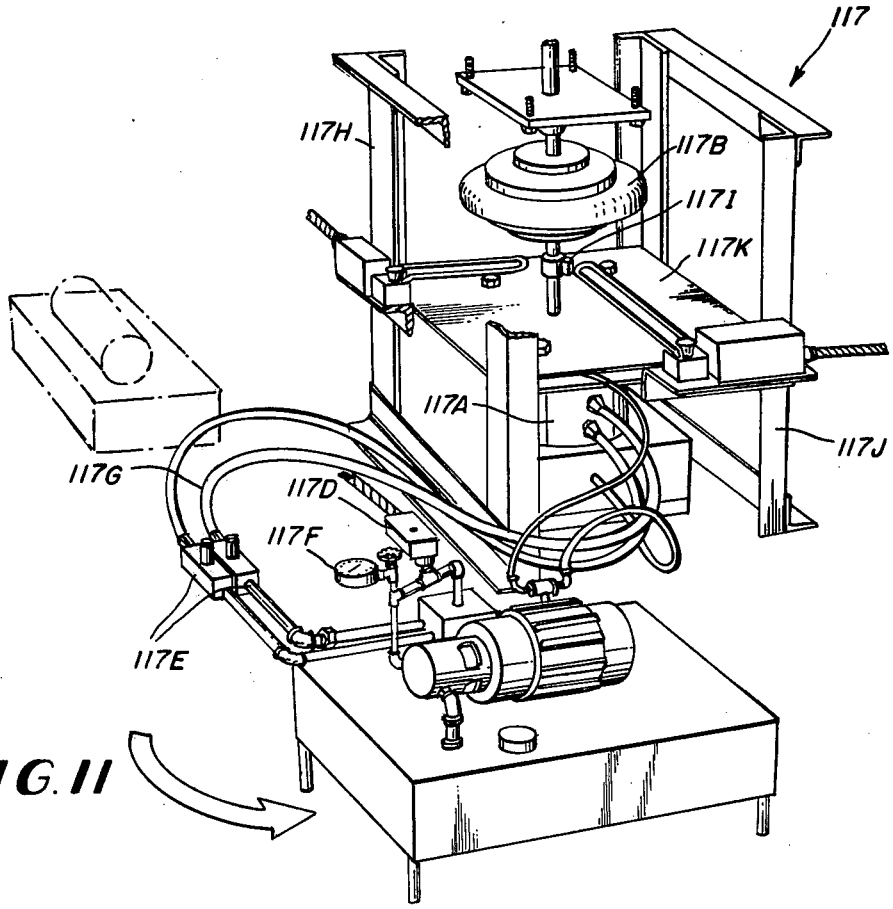
FIG. 11 illustrates a perspective view of the rotary actuator.

A more detailed description of the rotary actuator 117 can be seen with respect to FIG. 11 of the drawings of the present application. The rotary actuator 117 includes the rotary actuator unit 117A. This rotary actuator unit 117A may be of the following model or type: a tork-model F-8-4 rotary actuator with single style A shaft. The rotary actuator 117 further includes an elastomer coupling 117B, which may be of the following type: Thomas No. 50 elastomer coupling with 2" bore on one side and $1\frac{3}{4}$" bore on the other side. Element number 117C represents two microswitches of the following type: Two microswitchs model LSA-2B with LSZ-61C actuators. Element number 117D represents a hydraulic pressure switch of the following type: Barksdale catalog number C9612-2 hydraulic pressure switch. Element 117E represents flow control valves of the following type: two Deltrol EDF 35B flow control valves. Element 117F represents a pressure gauge, a UCC products type limited, model number UC-1519, 0-1000 PSI. Element 117G are hydraulic hoses, $2\frac{3}{4}$" diameter×4' length for 1000 PSI working pressure. Element 117H is the structural portion of the FIGAL washer 70 which houses the rotary actuator 117. Element 117I is a limit switch actuator manufactured by Tork-mor. Element 117J is also a portion of the rotary actuator mounting frame, a portion of the structure of the FIGAL washer 70. Element 117K represents a mounting plate for mounting the elastomer coupling 117B thereon.

In response to the loading of the FIGAL container 60 into the first zone, that is, the pre-rinse zone, a timer will begin to time out and a signal will be generated when a predetermined time has elapsed. This signal will energize the air cylinder 116 for pulling the angle 113 backwardly, removing the transfer valves 114 from the carriage bases. Once the air cylinder 116 pulls the transfer valves 114 away from the carriage bases, another signal is generated which energizes the rotary actuator from moving the carriages to the next zone position. The timer starts again, timing out in response to the lapse of the predetermined period of time. The cycle continues in this fashion. Each time the rotary actuator moves the carriage to the next adjacent position, a signal energizes the discharge cylinder 98 for ejecting the FIGAL containers 60, present in the Unload Zone, from the FIGAL washer 70.

In operation, a FIGAL container 60 is loaded into the carriage 110, by placing it upside down such that the valves 64A and 64B will be mated with the valve 110G3 and 110G4 of the carriage base. The wheels 110E will hold the FIGAL container 60 in the carriage, with the aid of the top loaded independently sprung wheels 112. The rotary actuator 117 will move the FIGAL container 60 to the first loading position, the pre-rinse zone 80B. The rail 100 will guide the FIGAL container through the washer, preventing the FIGAL container from jamming the FIGAL washer. The carriage bearing 111A on each of the carriages will move the carriages from one zone to another, and due to the shoulder 111B2 on the carriage bearing 111B, there will be a minimal amount of wear on the carriage bearing as the carriage is moved throughout the washer. Since the carriage 110 has a single plate 110G2, the two valves 110G3 and 110G4 will not be out of adjustment or out of alignment when a FIGAL container 60 must be loaded therein. When the FIGAL container is ready to be introduced into the first wash zone 80D, the air cylinder 116 will pull the angle 113 rearwardly, removing the transfer valves 114 from their contact position with the carriage base 110G1. The rotary actuator will then drive the carriage to the first wash zone 80D. The air cylinder 116 will then push the angle 113 forwardly, such that the transfer valves 114 contact the carriage base 110G1. Water from the water source 115A will then be introduced through either the pipe 115 or the hose 115A, through the holes 113C, 114E, 114A1, and through the hole in the carriage base 110G5, and will be introduced through the hoses 110G6, through the valves 110G3 and 110G4 on the carriage for washing the inside of the FIGAL container 60. Upon the completion of the washing of the FIGAL container in the first wash zone 80D, the air cylinder will pull the angle 113 backward, removing the transfer valve from the base 110G1 of the carriage, permitting the rotary actuator 117 to move the FIGAL container 60, and its associated carriage, to the next wash loading zone 80D. The air cylinder 116 will then move the angle 113 forwardly, until the transfer valve 114 contacts the carriage base 110G1. At this point, water will be introduced in the manner discussed above from the water source 115A. A transfer valve 114 will be utilized for each of the wash and rinse zones within the FIGAL washer 70. When the FIGAL container 60 enters the unloading zone 80K, the discharge cylinder 90A will push the rods 90A1 outwardly into an extended position. Since this rod 90A1 is centered intermediate the two stainless steel angles 110A of the carriage 110, the rod will contact the FIGAL container 60, when extended, and will therefore eject the FIGAL container 60 from its associated carriage.

The invention being thus described, it will be obvious that the same may be varied in many ways. Such variations are not to be regarded as a departure from the sphere and scope of the invention, and all such modifications as would be obvious to one skilled in the art are intended to be included in the scope of the following claims.

What is claimed is:

1. A carriage for carrying a container through a system for washing said container, comprising:

base means for supporting the weight of said container;

vertical support means attached to said base means for supporting said container along a length dimension and for preventing said container from falling in a first direction;

transverse support means attached to said vertical support means for transversely supporting said container and for preventing said container from falling in a second direction, different from said first direction; and valve means attached to said base means and being connected to a water source means, said valve means on said base means being connected to a valve means on said container when said container is loaded onto said carriage.

2. A carriage in accordance with claim 1 wherein said transverse support means comprises a pair of lever arms outwardly extending from said vertical support means for holding said container therebetween.

3. A carriage in accordance with claim 2 wherein said lever arms have an arcuate shape at their outward extremities, said arms being bent towards each other to securely hold said container therein.

4. A carriage in accordance with claim 3 wherein said lever arms further include a pair of wheels attached to said pair of lever arms, respectively, for guiding said container as said container is loaded onto said carriage.

5. A carriage in accordance with claim 2 wherein said transverse support means further comprises a pair of independently sprung top mounted wheels mounted at the top of said vertical support means for rolling along one end of said container as said container is loaded into said carriage.

6. A carriage in accordance with claim 5 wherein said base means comprises a single plate means mounted transversely along the top of said base means and secured to opposite ends thereof for securing said valve means to said base means.

7. A carriage in accordance with claim 6 wherein said valve means comprises a pair of valves, each of said valves being mounted and secured to a top portion of said single plate means.

8. A carriage in accordance with claim 5 or 6 further comprising a loading guide means attached to said vertical support means below said pair of lever arms for guiding the loading of said container onto said carriage.

9. A carriage in accordance with claim 1 or 6 wherein said base means further comprises carriage bearing means including a bolt portion and a roller portion, said bolt portion including a shaft, a head, and a shoulder portion disposed between said head and said shaft, said shaft being threaded, said shoulder portion having an outer peripheral surface being a smooth surface.

10. A carriage in accordance with claim 9 wherein the outer diameter of the shoulder portion of said bolt portion is greater than the outer diameter of the shaft.

11. A carriage in accordance with claim 10 wherein said roller portion is axially mounted around the smooth outer peripheral surface of said shoulder portion.

12. A system for washing a plurality of containers comprising an outer housing;

a horizontal track arranged longitudinally within said housing, said track extending through a plurality of washing, rinsing, and drying zones;

a plurality of carriage means riding on said track for carrying said containers through said washer, each of said plurality of carriage means including, base means for supporting the weight of a said container vertical support means attached to said base means for supporting said container along a length dimension and for preventing said container from falling in a first direction, transverse support means attached to said vertical support means for transversely supporting and container and for preventing said container from falling in a second direction, different than said first direction, and valve means attached to said base means and being connected to a water source means, said valve means on said base means being connected to a valve means on one of said containers when said container is loaded onto said carriage means; and means for moving said plurality of carriage means through said plurality of washing, rinsing, and drying zones of said washer.

13. A washer in accordance with claim 12 wherein said transverse support means comprises a pair of lever arms outwardly extending from said vertical support means for holding said container therebetween.

14. A washer in accordance with claim 13 wherein said lever arms have an arcuate shape at their outward extremities, said arms being bent towards each other to securely hold said container therein.

15. A washer in accordance with claim 14 further comprising a pair of wheels attached to the outer extremities of said pair of lever arms, respectively, for guiding said container as said container is interposed between said lever arms upon the loading of said container onto said carriage.

16. A washer in accordance with claim 13 wherein said transverse support means further comprises a pair of independently sprung top mounted wheels mounted at the top of said vertical support means for rolling along one end of said container as said container is loaded into said carriage.

17. A washer in accordance with claim 16 wherein said base means comprises a single plate means mounted transversely along the top of said base means and secured to opposite ends thereof for securing said valve means to said base means.

18. A washer in accordance with claim 17 wherein said valve means comprises a pair of valves, each of said valves being mounted and secured to a top portion of said single plate means.

19. A washer in accordance with claim 17 or 18 further comprising a loading guide means attached to said vertical support means below said pair of lever arms for guiding the loading of said container onto said carriage.

20. A washer in accordance with claims 12 or 17 wherein said base means further comprises carriage bearing means including a bolt portion and a roller portion, said bolt portion including a shaft, a head, and a shoulder portion disposed between said head and said shaft, said shaft being threaded, said shoulder portion having an outer peripheral surface being a smooth surface.

21. A washer in accordance with claims 12, 15, or 18 further comprising;

rail means disposed adjacent said carriage means, structurally mounted to said housing, and horizontally positioned at a point intermediate the ends of said containers when said containers are loaded into said carriage means for preventing said containers from dislodging from their proper position within said carriage means thereby preventing jamming of the carriages while being moved through said washer.

22. A washer for washing a plurality of containers, comprising an outer housing;

a horizontal track arranged longitudinally within said housing, said track extending through a plurality of washing, rinsing, and drying zones;

a plurality of carriage means riding on said track for carrying said containers through said washer, each of said carriage means including a base for supporting a said container, said base including a first valve means for connection with a second valve means on the said container, said first valve means being connected to one end of a hose means, said base further including a forward strip having a hole disposed therethrough, the other end of said hose means connecting with the hole disposed through said forward strip of said base;

at least one angle means disposed longitudinally of said washer, located adjacent said horizontal track, and positioned in alignment with the base of said carriage means, said angle means having a hole disposed therethrough;

a plurality of a transfer valve means connected to said angle means and disposed between the angle means and the forward strip of said base means for contacting the forward strip, each of said transfer valve means having a hole disposed therethrough;

push-pull means connected to said angle for pulling said angle and the attached plurality of transfer valve means away from the forward strip of the base of said carriage means prior to the movement of said carriage means from one of the zones to another of the zones, said push-pull means pushing said angle and the attached plurality of transfer valve means toward the forward strip of the base of said carriage means when the carriage means has been moved to said another of the zones, the holes in said angle means, said transfer valve means, and said forward strip of said base of said carriage means being in alignment when the carriage means stops at said another of the zones.

23. A washer in accordance with claim 22 further comprising a source of liquid for introducing said liquid into said container, said liquid from said source of liquid passing through the aligned holes in said angle means, said transfer valve means, and said forward strip after said push-pull means pushes said angle means and the attached transfer valve means into contact with the forward strip of said base of said carriage means.

* * * * *